US012668922B2

(12) United States Patent
Grohmann et al.

(10) Patent No.: US 12,668,922 B2
(45) **Date of Patent: *Jun. 30, 2026**

(54) ROLL COVER AND ROLL

(71) Applicant: Voith Patent GmbH, Heidenheim (DE)

(72) Inventors: Franz Grohmann, Schmidsdorf (AT); Nina Eggers, Neunkirchen (AT); Anton Horak, Vienna (AT); Stefan Pollaschek, Traiskirchen (AT)

(73) Assignee: Voith Patent GmbH, Heidenheim (DE)

( * ) Notice: Subject to any disclaimer, the term of this patent is extended or adjusted under 35 U.S.C. 154(b) by 259 days.

This patent is subject to a terminal disclaimer.

(21) Appl. No.: 18/503,713

(22) Filed: Nov. 7, 2023

(65) Prior Publication Data

US 2024/0068164 A1 Feb. 29, 2024

Related U.S. Application Data

(63) Continuation of application No. PCT/EP2022/058221, filed on Mar. 29, 2022.

(30) Foreign Application Priority Data

May 12, 2021 (DE) ..... 10 2021 112 370.4

(51) Int. Cl.
*D21F 3/08* (2006.01)
*D21G 1/02* (2006.01)

(52) U.S. Cl.
CPC ..... *D21F 3/086* (2013.01); *D21G 1/0233* (2013.01)

(58) Field of Classification Search
CPC ..... D21F 3/086; D21F 3/105; D21G 1/0233
See application file for complete search history.

(56) References Cited

U.S. PATENT DOCUMENTS 5,553,381 A * 9/1996 Lehtonen ..... B05D 1/10 492/53
9,488,217 B2 11/2016 Harvey
2007/0111871 A1 5/2007 Butterfield et al.
2013/0105101 A1 5/2013 Turunen
2015/0087490 A1 3/2015 Harvey
2019/0161913 A1* 5/2019 Turunen ..... D21G 1/0213

FOREIGN PATENT DOCUMENTS

CN 106192535 A * 12/2016 ..... D21F 5/02

OTHER PUBLICATIONS

English Description of CN106192535A retrieved from Espacenet (Year: 2025).*

(Continued)

*Primary Examiner* — Abbas Rashid
*Assistant Examiner* — Elisa H Vera
(74) *Attorney, Agent, or Firm* — TAYLOR & EDELSTEIN, PC

(57) ABSTRACT

A roll cover and a roll in particular for use in a machine line for the production or processing of a fibrous web is provided, wherein the roll cover includes a radial outer functional layer which provides the surface of the roll cover in contact with the web, and wherein the functional layer has structural elements, in particular in the form of grooves and/or bores, wherein the functional layer is constructed of an elastomer material with a Poisson number greater than 0.4, between 0.45 and 0.5.

16 Claims, 1 Drawing Sheet

(56) References Cited

OTHER PUBLICATIONS

R. Kosso, "Mechanical Properties of Rubbers Reinforced with Porcellinite-Derived Precipittaed Silica", Fall 170th Technical Meeting of the Rubber Division, American Chemical Society, Feb. 22, 2007 (18 pages).
Ö. Pósfalvi, "Uber Das Elastizitatsgesetz und Die Poissonsche Zahl Von Gummielastischen Werkstoffen", O. Periodica Polytechnica, Transportation Engineering, Jan. 14, 1982, Budapest, pp. 61-66 (6 pages).
English machine translation of Ö. Pósfalvi, "Uber Das Elastizitatsgesetz und Die Poissonsche Zahl Von Gummielastischen Werkstoffen", O. Periodica Polytechnica, Transportation Engineering, Jan. 14, 1982, Budapest, pp. 61-66 (6 pages).
German Office Action dated Feb. 2, 2022 for German Patent Application No. 10 2021 112 367.4 (6 pages).
Notification of the Transmission of the International Search Report and Written Opinion of the International Search Authority or Declaration dated Aug. 9, 2022 for International Application No. PCT/EP2022/058221 (13 pages).

* cited by examiner

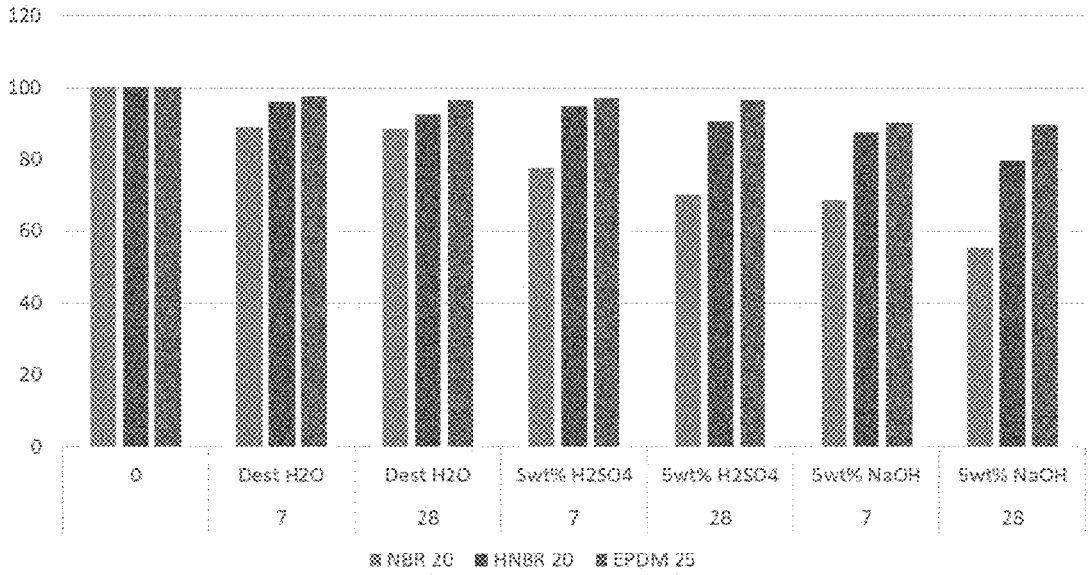
120
100
80
60
40
20
0
0
Dest H2O
7
Dest H2O
28
5wt% H2SO4
7
5wt% H2SO4
28
5wt% NaOH
7
5wt% NaOH
28
NBR 20
HNBR 20
EPDM 25

ROLL COVER AND ROLL

CROSS REFERENCE TO RELATED APPLICATIONS

This is a continuation of PCT application no. PCT/EP2022/058221, entitled "ROLL COVER AND ROLLER", filed Mar. 29, 2022, which is incorporated herein by reference. PCT application no. PCT/EP2022/058221 claims priority to German application no. 10 2021 112 370.4, filed May 12, 2021, which is incorporated herein by reference.

BACKGROUND OF THE INVENTION

1. Field of the Invention

The present invention relates to rolls, and, more particularly, to roll covers.

2. Description of the Related Art

In industrial installations such as paper machines, a multitude of rolls are used. These rolls can be used to guide the material web, or to influence the surface properties. Another important area of application for such rolls is pressing and dewatering of the fibrous web. In this process, a press roll with a counter element—often in the embodiment of a counter roll—forms a treatment nip for mechanical dewatering of the fibrous web. The water can then be partially absorbed into structures of the roll surface, such as grooves or (blind) bores. These structures provide a storage capacity for the squeezed-out water.

The problem with rolls with relatively soft roll surfaces is, however, that the cover is compressed by the force acting in the treatment nip, causing the grooves or bores to be completely or at least partially closed up, and the storage capacity decreases.

To ensure sufficient water absorption capacity and to avoid rewetting of the paper web after it exits the treatment nip, it is proposed in patent specification U.S. Pat. No. 9,488,217 to design the grooves and bores very wide relative to their depth. Specifically, it is proposed that the width or the diameter should be at least 70% of the depth or more.

The disadvantage of this solution, however, is the fact that by widening the grooves and bores, the intermediary bars, in other words the part of the roll surface that is responsible for building up the hydraulic pressure in the treatment nip, necessarily become smaller. This hinders the build-up of the highest possible hydraulic pressure, and thus an intensive squeezing of the web.

In addition, wide grooves and/or large diameter holes often cause marks in the paper. This can occur, for example, in the form of so-called "bore shadow markings", which are caused by an uneven washing out of fines and fillers from the paper web.

What is needed in the art is to overcome the problems known from the state of the art.

In particular, what is needed in the art is a roll cover or respectively a roll which provides sufficient storage volume and at the same time can build up sufficient hydraulic pressure in the treatment nip.

SUMMARY OF THE INVENTION

The present invention relates to a roll cover for a roll, particularly for use in an installation for the production or processing of a fibrous web, wherein the roll cover includes a radial outer functional layer which provides the surface of the roll cover in contact with the web, and wherein the functional layer has structural elements, in particular in the form of grooves and/or bores. The present invention also relates to an associated roll.

Within the framework of this application, the terms material web, fibrous web, and paper web are used interchangeably. This includes in particular pulp webs, webs for graphic paper or packaging paper, cardboard webs, tissue webs, and webs for specialty papers.

In regard to the roll cover, the present invention provides a roll cover for a roll in particular for use in a machine line for the production or processing of a fibrous web, wherein the roll cover includes a radial outer functional layer which provides the surface of the roll cover in contact with the web, and wherein the functional layer has structural elements, in particular in the form of grooves and/or bores.

The present invention provides that the functional layer is composed of an elastomer material that has a Poisson's ratio higher than 0.4.

In particular, provision can be made that the elastomer material has a Poisson's ratio between 0.45 and 0.5, for example 0.47, 0.48 or 0.49.

Optional designs may provide that a rubber material, in particular a rubber formulation based on HNBR (hydrogenated acrylonitrile butadiene rubber) or EPDM (ethylene propylene diene rubber), will be used as the elastomer material. Alternatively, other elastomer materials, such as polyurethanes, can also be used.

The Poisson's ratio—also referred to as transverse contraction number, transverse strain or transverse expansion ratio—is a material parameter in mechanics or strength of materials theory. It is used to calculate transverse contraction and is one of the elastic constants of a material.

As is known, the Poisson's ratio is defined as the linearized negative ratio of the relative change in dimension transverse to the uniaxial stress direction to the relative change in length when subjected to a one-dimensional mechanical stress condition:

If a sample (a solid piece of material, for example S1 or S2 strips according to DIN 53504) is stretched by pulling it apart at its ends ("in the longitudinal direction"), this can influence its volume. For a sample whose material has a Poisson's ratio close to 0.5, the volume remains (almost) the same. If it is pulled longer, it becomes only just thin enough that its volume remains (practically) the same.

Since the roll covers are often operated at temperatures between 50° C. and 60° C., it would be desirable to also determine the Poisson's ratio at these operating temperatures.

However, the effort required to suitably temper the measuring device is relatively great. Therefore, the Poisson's ratios cited within the scope of this application are measured under laboratory conditions, that is at 20° C. The Poisson's ratio hardly changes over a wide range of temperatures. Substantial changes are only to be expected below the glass transition temperature which is in the region of −20° C. for such elastomers, or above 80° C.-100° C. Therefore, a measurement at 20° C. is also representative for use at 50°-60° C.

However, a Poisson's ratio measured in the tensile test depends on the traction speed at which the test is carried out. At low speeds (for example 10 mm/min) relaxation effects also occur and are recorded, which are not relevant for the very rapid deformation in the press nip that occurs in practice. No significant speed dependence was detected at speeds greater than 100 mm/min. The described measured values were therefore determined at a speed of 125 mm/min, an initial force of 1N in the range of 1.5-2.5% elongation and a measuring length (Lo) of 25 mm in the case of the S1 strip and 20 mm in the case of the S2 strip. Due to the dispersion of the measured values, the median value of at least 3, ideally at least 5, individual measurements was used.

The inventors have recognized that the material behavior of a roll cover in a treatment nip can effectively be characterized by way of this material parameter. In the case of an elastomer material, especially a rubber material, with a Poisson's ratio above 0.4, especially between 0.45 and 0.5, there are no or only minor undesirable material deformations even at relatively high pressures in the treatment nip. This provides a great deal of freedom to introduce structures into the surface of the roll cover. These structures are then not at all, or only insignificantly, changed in the treatment nip, and their storage capacity is largely retained.

In particular, in contrast to the state of the art, it may be provided that the roll cover has grooves as structural elements, and that the ratio of the groove width relative to the groove depth is less than or equal to 0.7, in particular less than or equal to 0.68, 0.65, 0.6 or 05.

Alternatively or in addition, it may be provided that the roll cover has bores as structural elements, and that the ratio of the bore diameters to the bore depth is less than or equal to 0.7, in particular less than or equal to 0.68, 0.65, 0.6 or 0.5.

In advantageous applications, the groove width and/or bore diameter may be between 0.7 mm and 1.4 mm, optionally between 0.8 mm and 1.1 mm.

It can moreover be advantageous if the groove depth and/or bore depth is between 1.2 mm and 2.5 mm, in particular between 1.8 mm and 2.2 mm.

For example, a groove width of 1.1 mm and a groove depth of 2 mm provides a ratio of 0.55. A groove width of 0.8 mm and a groove depth of 2.5 mm results in a ratio of 0.32.

Roll covers according to aspects of the current invention also allow provision of large open areas of up to 40% or 45% in the roll cover. For example, in the case of a grooved roll cover, the open area can be 28%, 33% or 34%. An open area of 33.3% means that with a groove width of 1 mm, the webs between the grooves have a width of 2 mm. In the case of roll covers, which have both grooves and bores, even larger open areas are possible. 28% to 38% are very common in this case.

These structural elements, which are rather deep in comparison to the width or diameter, can provide sufficient storage volume and still build up sufficient hydraulic pressure in the treatment nip.

The hardness specifications "P&J" refer to the measurement according to Pusey & Jones. In this measurement, softer materials have higher P&J values. The statement that a roll cover has a greater than 10 P&J therefore means that the cover should be softer than 10 P&J.

In particularly advantageous designs, a soft roll cover can be provided. Provision may be made in particular that the hardness of the functional layer is greater than 10 P&J, in particular between 15 P&J and 50 P&J. Hardness values of 20 P&J, 25 P&J, 30 P&J or 35 P&J are common. Such levels of hardness can be achieved very easily, especially with a rubber material, especially a rubber formulation based on HNBR (hydrogenated acrylonitrile butadiene rubber) or EPDM (ethylene propylene diene rubber).

The rolls, and especially the roll covers, are exposed to very harsh conditions when used, for example in a paper machine. Mechanical influences such as pressure in a roll nip and friction, but also the chemical influence of the various process waters and process chemicals lead to constant wear and tear of the roll cover. This wear is particularly disturbing in the case of rolls with structural elements, where, as described above, it is advantageous if the depth of the structural elements is relatively large compared to their diameter or width or if a certain ratio is to be maintained (for example width/depth <0.7 or <0.6 mm). If, for example, ¼ of the thickness of the cover is removed due to wear, while the width of the structure remains the same, the width/depth ratio increases by ⅓. As a result, there is a risk that the width/depth ratio will no longer be within the desired range.

Furthermore, the characteristics of the material of the roll covers can also change as a result of the use of the rolls. Depending on the elastomer material used, it can for example lead to hardening or softening of the material or the roll surface.

It is therefore advantageous to keep the wear of the roll cover as low as possible by selecting the appropriate surface material. For a roll cover according to one aspect of the present invention, it may therefore be advantageous if the elastomer material, in particular in the case of a rubber material, has one, several, or all of the following characteristics:

Characteristic 1: Water Resistance

Within the scope of this application, an elastomer material is to be described as water-resistant if, during 672 h of storage at 70° C. in water with pH=7, the hardness of the elastomer material changes by a maximum of 5 P&J, optionally 4 P&J, optionally 3 P&J, in particular 1 P&J or less.

Characteristic 2: Acid Resistance

Within the scope of this application, an elastomer material shall be designated as acid-resistant if, during 672 h of storage at 70° C. in sulfuric acid ($H_2SO_4$) with pH=1.5, the hardness of the elastomer material changes by a maximum of 5 P&J, optionally 3 P&J in particular 1 P&J or less.

Characteristic 3: Alkali Resistance

Within the scope of this application, an elastomer material shall be designated as alkali-resistant if, during 672 h of storage at 70° C. in caustic soda (NaOH) with pH=14, the hardness of the elastomer material changes by a maximum of 10 P&J, optionally 5 P&J, in particular 3 P &J or less.

Characteristic 4: Tensile Stress Constancy

The products that can provide a constant dewatering performance are consistent over a wide range of media. Materials are herein advantageous in which the tensile stress value of the elastomer material changes by less than 10%, optionally less than 8% at 10% elongation ("module 10", measured in the tensile test on the S1 or S2 strip according to DIN 53504) during 672 h of storage at 70° C. in water pH=7 and/or 5 weight-% sulfuric acid and/or 5 weight-% caustic soda.

In optional designs, a rubber material can be used as an elastomer material that has all four characteristics, or at least characteristics 1, 2 and 3 combined.

In regard to the roll, the present invention provides a roll for a machine line for producing or processing of a fibrous web including a substantially cylindrical roll core and a roll cover applied to it, wherein the roll cover is designed according to one aspect of the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawing, wherein:

FIG. 1 shows the relative changes in the module 10 value for the materials from examples 1 and 2 as well as the reference material when stored in different media over 7 or respectively 28 days (672 hours).

Corresponding reference characters indicate corresponding parts throughout the several views. The exemplification set out herein illustrates at least one embodiment of the invention, and such exemplification is not to be construed as limiting the scope of the invention in any manner.

DETAILED DESCRIPTION OF THE INVENTION

The present invention is further explained below, with reference to examples.

The examples specify some examples of elastomers suitable for use in a roll cover according to one aspect of the present invention. These are different rubber materials. However, the present invention is not limited to these exemplary formulations.

The information on hardness or change in hardness is, unless explicitly described otherwise, to be found in P&J (Pusey & Jones).

Example Formulation 1: EPDM 25

| Category | Designation | Amount (wt-%) |
|---|---|---|
| Polymer | EPDM | 40-60 |
| Filler 1 | Soot | 25-35 |
| Filler 2 | Mineral | 5-10 |
| Crosslinking agent | Peroxide | 2-3 |
| | Other additives | Remainder to 100% |

Prior to storage, this rubber material has a hardness of between 25 and 30 P&J.

Example Formulation 2: HNBR 20

| Category | Designation | Amount (wt-%) |
|---|---|---|
| Polymer | HNBR | 40-50 |
| Filler | Soot | 20-30 |
| Softener | Ester | 2-4 |
| Crosslinking agent | Peroxide | 2-4 |
| | Other additives | Remainder to 100% |

Prior to storage, this rubber material has a hardness of between 20 and 25 P&J.

Consideration of storage in various media (pH values & chemicals) has proven to be effective in assessing the material behavior in the roll nip.

Table 1 shows the change in hardness in materials stored for 7, as well as for 28 days (=672 hours) in water, NaOH and $H_2SO_4$. Storage occurs at a temperature of 70° C.

Hardness changes which are shown in the following table were measured for example formulations 1 and 2, as well as for the reference formulation NBR 20 based on acrylonitrile butadiene rubber. The reference formulation also had a hardness of between 20 and 25 P&J before storage, which was however slightly below the hardness of HNBR 20.

In all three formulations, the elastomer material has a Poisson's ratio above 0.4, especially between 0.45 and 0.5. Thus, the materials are generally all suitable for use in a roll cover according to one aspect of the current invention.

TABLE 1

| Change in hardness after 672 h storage in [P&J] | | | |
|---|---|---|---|
| | Water (pH = 7) | H2SO4 (pH = 1.5) | NaOH (pH = 14) |
| EPDM 25 | +1 P&J | +1 P&J | +2 P&J |
| HNBR 20 | +3 P&J | +2 P&J | +4 P&J |
| NBR 20 | +4 P&J | +5 P&J | +10 P&J |

One recognizes that in all cases the materials have a higher P&J value after storage, and thus become softer. However, the extent of this softening is highly dependent on the polymer material.

One recognizes that sample formulation 1 (EPDM 25) undergoes only a very small change in hardness in all storage situations. Even under the generally harshest conditions in caustic soda, an increase of only 2 P&J is measured. The material is therefore superbly water-resistant, acid-resistant, and alkali-resistant.

Sample formulation 2 (HNBR 20) also shows only a relatively small change in hardness in all storage situations. The material is therefore proficiently water-resistant, acid-resistant and alkali-resistant. Regardless, the measured change in hardness is already approximately twice as large as with formulation 1.

The reference formulation (NBR 20) shows by far the greatest changes in hardness. When stored in caustic soda, the hardness change is 10 P&J.

The changes in hardness of this reference formulation in water, acid and especially in lye are at the limit of what can still be considered stable. In applications where these resistance properties are important, it is advantageous not to use a formulation with such hardness changes and instead to rely on clearly more durable alternatives such as formulations 1 or 2.

The products that can provide a constant dewatering performance proved consistent over a wide range of media. An excellent indicator of this is the measurement variable "module 10". It is generally advantageous if the tensile value of the elastomer material changes only slightly at 10% elongation ("module 10", measured in the tensile test on the S1 or S2 strip according to DIN 53504) during storage in water, lye or acid.

Utilization of a material in which the tensile value "module 10" changes less than 10%, optionally less than 8%, during 672 hours of storage in water at 70° C. ensures constant drainage conditions over the life of the cover.

FIG. 1 shows the relative changes in the module 10 value for the materials from examples 1 and 2 as well as the reference material when stored in different media over 7 or respectively 28 days (672 hours).

As in the investigation of the change in hardness, a considerable difference of the elastomer materials is noticeable.

Here, too, EPDM 25 proves to be highly advantageous, as the module 10 value changes by less than 10% even after 28 days, in most cases even by less than 8% when stored in water pH=7.5 weight-% sulfuric acid and also in 5 weight-% caustic soda.

HNBR also displays beneficial properties. When stored in water as well as in sulfuric acid, the change in module 10 value remains below 10% or even below 8%. Only when stored in caustic soda, the module 10 value is only around 80% of the initial value after 28 days.

Here, too, NBR 20 presents the worst performance. When stored in water, there is a pronounced change in elongation already after 7 days, and after 28 days in the range of approximately 10%. When stored in sulfuric acid or caustic soda, the module 10 value drops severely with NBR 20. After 28 days of storage in sulfuric acid, the value is only between 50% and 60% of the initial value.

Also, with regard to the module 10 value, the use of NBR 20 will not be optimal for many applications, so that here too, alternatives as described in examples 1 and 2 are preferred.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A roll cover for a roll, the roll cover comprising:

a surface configured for being in contact with a web of fibrous material, the surface being formed by a radial outer functional layer, the radial outer functional layer including a plurality of structural elements and being composed of an elastomer material that has a Poisson's ratio greater than 0.4, a rubber material being used as the elastomer material, a hardness of the radial outer functional layer being greater than 10 Pusey & Jones (P&J) and less than 35 P&J, the rubber material having a rubber formulation based on hydrogenated acrylonitrile butadiene rubber (HNBR) or ethylene propylene diene rubber (EPDM).

2. The roll cover according to claim 1, wherein the roll cover is for the roll which is configured for being used in a machine for producing or processing the web of fibrous material, wherein the plurality of structural elements are at least one of a plurality of grooves and a plurality of bores.

3. The roll cover according to claim 1, wherein the plurality of structural elements includes a plurality of grooves each of which includes a groove width and a groove depth, and wherein a ratio of the groove width to the groove depth is less than or equal to 0.7.

4. The roll cover according to claim 3, wherein the ratio of the groove width to the groove depth is less than or equal to 0.5.

5. The roll cover according to claim 1, wherein the plurality of structural elements includes a plurality of bores each of which includes a bore diameter and a bore depth, and wherein a ratio of the bore diameter to the bore depth is less than or equal to 0.7.

6. The roll cover according to claim 5, wherein the ratio of the bore diameter to the bore depth is less than or equal to 0.5.

7. The roll cover according to claim 1, wherein the hardness of the radial outer functional layer is between 15 P&J and 50 P&J.

8. The roll cover according to claim 1, wherein the elastomer material is water-resistant, such that during 672 hours of storage at 70° C. in water with pH=7 a hardness of the elastomer material changes by a maximum of 5 P&J.

9. The roll cover according to claim 8, wherein the hardness of the elastomer material changes by 3 P&J or less.

10. The roll cover according to claim 1, wherein the elastomer material is acid-resistant, such that during 672 hours of storage at 70° C. in sulfuric acid ($H_2SO_4$) with pH=1.5 a hardness of the elastomer material changes by a maximum of 5 P&J.

11. The roll cover according to claim 10, wherein the hardness of the elastomer material changes by 3 P&J or less.

12. The roll cover according to claim 1, wherein the elastomer material is alkali-resistant, such that during 672 hours of storage at 70° C. in caustic soda (NaOH) with pH=14 a hardness of the elastomer material changes by a maximum of 10 P&J.

13. The roll cover according to claim 12, wherein the hardness of the elastomer material changes by 5 P&J or less.

14. The roll cover according to claim 1, wherein a tensile stress value of the elastomer material changes by less than 10%, at 10% elongation ("module 10", measured in a tensile test on an S1 or S2 strip according to DIN 53504) during 672 hours of storage at 70° C. in water with at least one of pH=7, 5 weight-% sulfuric acid, and 5 weight-% caustic soda.

15. The roll cover according to claim 14, wherein the tensile value of the elastomer material changes by less than 8%.

16. A roll for a machine line for producing or processing a web of fibrous material, the roll comprising:

a roll core which is substantially cylindrical; and a roll cover applied to the roll core, wherein the roll cover includes a surface configured for being in contact with the web of fibrous material, the surface being formed by a radial outer functional layer, the radial outer functional layer including a plurality of structural elements and being composed of an elastomer material that has a Poisson's ratio greater than 0.4, a rubber material being used as the elastomer material, a hardness of the radial outer functional layer being greater than 10 Pusey & Jones (P&J) and less than 35 P&J, the rubber material having a rubber formulation based on hydrogenated acrylonitrile butadiene rubber (HNBR) or ethylene propylene diene rubber (EPDM).

* * * * *